United States Patent [19]

Hidvegi

[11] Patent Number: 4,589,853

[45] Date of Patent: May 20, 1986

[54] CONSTRUCTION SET, PREFERABLY A TOY SET

[75] Inventor: Valeria Hidvegi, Budapest, Hungary

[73] Assignee: Kozponti Valto- es Hitelbank Rt. Innovecios Alap, Budapest, Hungary

[21] Appl. No.: 666,087

[22] PCT Filed: Jan. 28, 1983

[86] PCT No.: PCT/HU83/00004

§ 371 Date: Sep. 20, 1983

§ 102(e) Date: Sep. 20, 1983

[87] PCT Pub. No.: WO84/02853

PCT Pub. Date: Aug. 2, 1984

[51] Int. Cl.[4] ..... A63H 33/12

[52] U.S. Cl. ..... 446/123; 446/111; 446/104

[58] Field of Search ..... 446/122, 123, 108, 109, 446/111, 102, 103, 104, 113

[56] References Cited

U.S. PATENT DOCUMENTS

| | | | |
|---|---|---|---|
| 1,996,722 | 4/1935 | Gilbert et al. | 446/122 |
| 3,355,837 | 12/1967 | Pedersen | 446/123 |

FOREIGN PATENT DOCUMENTS

| | | | |
|---|---|---|---|
| 97534 | 7/1924 | Austria | 446/122 |
| 694658 | 12/1930 | France | 446/122 |
| 902734 | 9/1945 | France | 446/122 |
| 954928 | 1/1950 | France | 446/108 |
| 524764 | 4/1955 | Italy | 446/122 |
| 169912 | 10/1921 | United Kingdom | 446/122 |

*Primary Examiner*—Robert A. Hafer
*Assistant Examiner*—Daniel Nolan
*Attorney, Agent, or Firm*—Sughrue, Mion, Zinn, Macpeak, and Seas

[57] ABSTRACT

A constructional toy set has building members and coupling members having dimensions which are equal to, multiples of, or specific fractions of a basic unit size, have a basic thickness or a multiple thereof, have through holes of basic hold diameter or multiples thereof with shapes symmetrical to either or both longitudinal and transversal axes thereof. End regions of the members may be semi-circular in form, and the through holes are positioned on the longitudinal axis or symmetrically to the sides thereof and at distances from themselves and the outermost points of the end region equal to set fractions of the basic size, equal to the basic size or to multiples thereof. The coupling members may be joined by threaded bolts and whose length is several times as long as the basic thickness. Nuts engage the bolts to lock the coupling members together. The configurations, dimensional proportions and relationships result in structural assemblies which are highly esthetically pleasing, with the figures simulating common animals, and which develops children's sense of space, form and harmony.

8 Claims, 46 Drawing Figures

CONSTRUCTION SET, PREFERABLY A TOY SET

The invention relates to a construction set, preferably a toy set, which comprises building members and coupling members.

There are a large number of constructional toys known all over the world which are popular and fashionable. These toys help developing children's manipulating ability, provide free scope for imagination, therefore they are toys of fancy, they develop children's creativity and inspire them to realize their ideas.

The constructional toys can be divided in two basic groups, i.e. planar and spatial toys. Planar toys comprise mainly planar elements, while the elements of spatial toys are bodies with three dimensions.

One of the most popular planar constructional toys is the so called Marklin-toy, which has perforated metal lamina as building members, metal-screws as coupling members and auxiliary members [e.g. wheels] made also of metal. The members can be mounted by means of tools only [e.g. pliers, fork wrench, screw driver]. This toy is used mainly for assembling machines [e.g. cars, cranes, etc.]. Its main advantage lies in that it helps children learning the use of tools; its disadvantage is on the other hand that it might develop a technocrate attitude and does not increase children's aesthetical sense and artistic instinct.

A spatial building toy has been placed on the market with the trade-name Matador. It has a set of members consisting of bodies of most common basic geometrical types made of wood [Such types are cubes, prisms, bricks and cylinders]. There are holes provided in the members and the members are interconnected by means of wood pins. The mounting of the members inevitably requires the use of various tools, first of all a hammer and pliers. This toy can be used also mainly for the assembling of machines, vehicles [airplanes, cars, helicopter]. The drawback of this system lies in that it also helps developing a technocratic attitude.

There is a spatial building toy known designed for developing manual skill and sense of proportion of children in the age of 1–3 years, which comprises basic geometrical bodies as constructional members, mainly rounded cylinder segments or rectangular prisms, and all of these members comprise a central bore by means of which they can be assembled on a vertical rod. This toy is disadvantageous in the sense that it has only very limited variational possibilities.

The object of the invention is to provide a construction set which can be used for assembling spatial bodies e.g. spatial toy figures in which the assembling operation does not require any tools what-so-ever, and which can develop children's manipulating ability, creativity, which can offer free scope to fantasy and has a large variability and can develop artistic instinct, too.

According to the present invention it has been discovered that the aforementioned drawbacks of conventional constructional toys can be eliminated or substantially reduced if the building and coupling members are selected in such a way, that their forms and shapes reflect certain geometrical proportions, by means of which the advantages of the planar and spatial toys will be combined.

According to the invention a construction set has been provided which can be used preferably as a toy set, which comprises building members and coupling members in which according to the present invention the building members comprise:

disc members with a diameter forming a basic size, the disc members have a common thickness which forms a basic thickness which is at least one sixth and at most one third of the basic size, the disc members have respective central throughgoing holes with a common diameter which forms a basic hole diameter and it is at least one sixth and at most one third of the basic size;

elongated members with shapes symmetrical both to the longitudinal and transversal axes thereof, the elongated members have a common width which is substantially equal to the basic size, and they have a common thickness substantially equal to the basic thickness, and the contour lines of the elongated elements in their end regions approach respective semicircles whose diameter is substantially equal to the basic size, there are respective throughgoing holes in the end regions of the elongated members which have diameters substantially equal to the basic diameter, the centre points of the holes lie in the longitudinal axes at a distance from the respective outermost points of the end regions and this distance is substantially equal to the half of the basic size.

The coupling members comprise:

threaded bolts with an outer diameter loosely fitting the holes which have their diameter equal to the basic diameter, and the length of these bolts is at least about three times as long as the basic thickness; and nuts for engagement with the bolts, the outer diameter of the nuts is smaller than the basic size and greater than the half of the basic size, and the thickness of the nuts is at most as great as the basic thickness.

According to a preferred embodiment the contour line in the end regions of the elongated members are formed by semi-circles.

According to a further embodiment the contour lines in the end regions of the elongated members are formed by linear sections osculating the semi-circles.

It is preferable if the nuts are circular and their width is substantially equal to the basic thickness.

The size proportions are optimum if the basic diameter is substantially equal to the basic thickness and to the quarter of the basic size.

According to a preferable embodiment of the invention the elongated members have lengths which are multiples of the basic size.

According to a further embodiment of the invention the building members comprise connecting members which have a width and height substantially equal to the basic size and the length thereof is at least equal to the basic size, and the connecting members are symmetrical relative to at least one symmetryc plane and comprise pairs of end planes normal to the symmetryc plane and a planar face normal to the end planes, and a connecting member each comprises at least two threaded bores with diverging axes for receiving and engaging said bolts.

In a further preferable embodiment each of the connecting members are formed by a semi-cylinder with a diameter equal to the basic size and by a rectangular prism attached integrally to the semi-cylinder.

It is preferable for the assembling operations if the connecting members define three threaded bores which have axes mutually normal to each other and which intersect each other in the middle of the connecting member.

For increasing the variability in a preferable embodiment the building members comprise additional elongated members which have a common thickness which is substantially equal to the basic thickness, the shape of the additional elongated members is similar to that of the elongated members mentioned hereinabove but they have a common width which is substantially twice as large as the basic size, and the additional elongated members also have in their end regions respective throughgoing holes which are substantially as large as the holes of the normal elongated members and their centre points lie in the longitudinal axes of the members at a distance from the outermost points which is substantially equal to the half of the basic size.

In a further embodiment the difference compared to this latter embodiment lies in, that the throughgoing holes are twice as far from the outermost points of the members, that is, their distance is equal to the basic size.

According to a further embodiment of the invention the building members comprise additional disc members which have a diameter twice as large as the basic size and they have central holes with diameters substantially as large as the basic diameter, and the thickness of these disc members is substantially equal to the basic thickness.

The variability of the construction set will be increased if according to a further embodiment of the invention the building members comprise semi-circular members with a diameter which is about twice as large as the basic size and which has a thickness which is substantially equal to the basic thickness, and each of the semi-circular members comprises at least one bore with a diameter equal to the basic diameter.

According to a further embodiment of the invention the building elements, mainly the elongated members comprise further throughgoing holes with diameters substantially equal to the basic diameter and which are at the central axis or symmetrically relative to the axis.

According to a further embodiment of the invention the coupling members comprise a cylinder with a diameter equal to the basic size or equal to the double of the basic size, and this cylinder is at least as long as the basic size and has a central bore with a size substantially as large as the basic diameter. This bore can be a throughgoing bore or a threaded bore. This cylindrical member can be used as a distance keeper, as a coupling element or as a building element.

According to a further embodiment of the invention the basic size referred to hereinabove is at least 25 mm but it is most preferable if the basic size is about 50 mm.

When the construction set according to the invention is used it can be easily understood, that the child will have much more combinational and variational possibilities than with conventional sets and owing to the spatial size-selection, the appearance of the assembled constructions will be more figurative and beyond a technocratic outlook. The artistic instinct is also developed and figures can be constructed which imitate living creatures like cats, dogs, etc.

The invention will not be described in connection with some preferable embodiments thereof, in which reference will be made to the accompanying drawings. In the drawings.

Figure 1:
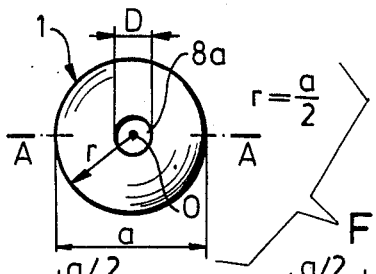
FIG. 1 shows a disc member.
Figure 8:
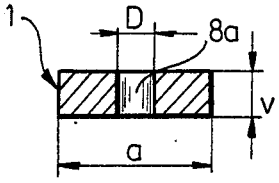
FIG. 8 is a sectional view taken along lines A—A of FIG. 1.

Reference is made now to FIGS. 1 and 8 in which member 1 is shown which has a diameter a which forms a basic size or basic dimensional unit value for the construction set. The radius r of the disc is equal to a/2. A throughgoing central circular hole 8*a* is made in the disc 1 which has a diameter D and a thickness v. The diameter D forms a basic diameter for the whole set and a thickness v forms a basic thickness. It is preferable if the basic diameter D is equal or substantially equal to the basic thickness v. It is also preferable if the thickness v is about a quarter of the basic size a.

Figure 2:
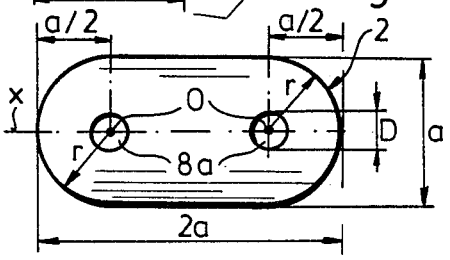
FIGS. 2–7 show a set of elongated members.
Figure 3:
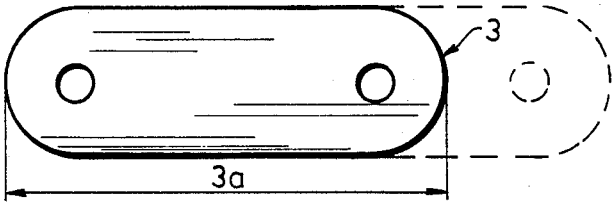
Figure 4:
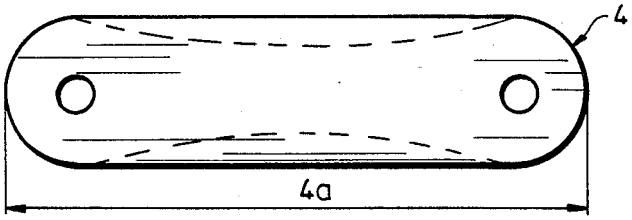
Figure 5:
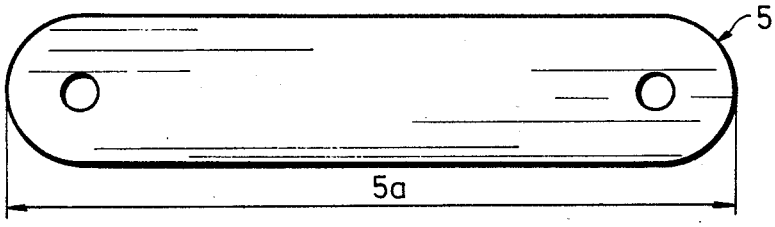
Figure 6:
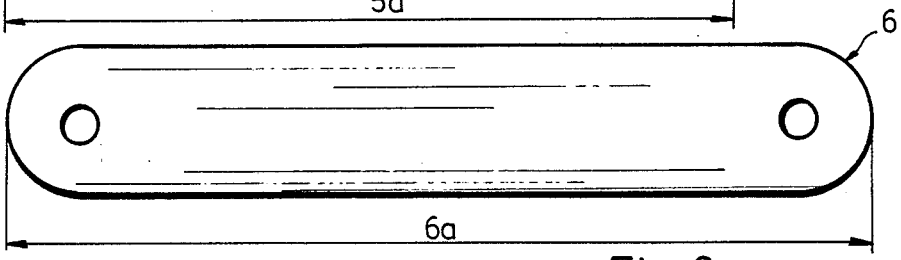
Figure 7:
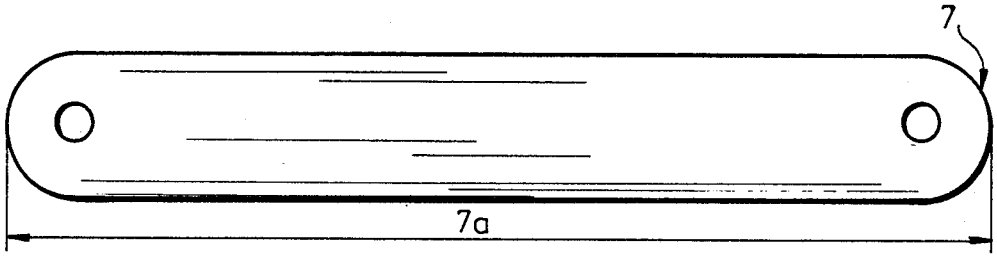

FIGS. 2–7 show elongated members 2–7 which have a width equal to the basic size a. The thickness of the elongated members 2–7 is equal to the basic thickness v. It is preferable if the length of the elongated members 2–7 is a multiple of the basic size a, i.e. it can be expressed as $n \times a$, in which n is an integer. The elongated members 2–7 are rounded at their end regions with respective semi-circles which have a diameter equal to the basic size a. It should be noted that the elongated members are symmetrical to their longitudinal and to their transversal axes. In the embodiments shown in FIGS. 2–7 the elongated members have linear sides parallel to the longitudinal axis. It can be seen in the dashed line of FIG. 4 that the sides of the elongated member can be made of appropriate arc sections. The end regions of the elongated members can be formed by linear sections which extend tangentially to the semi-circles. This embodiment is shown in FIG. 3 with the dashed lines. The elongated members have respective pairs of throughgoing holes 8*a* at their end regions, and the distance between the outermost points of the members and the central points O of the throughgoing holes 8*a* is equal to the half of the basic size a i.e. a/2. The diameter of the throughgoing holes 8*a* is equal to the basic diameter D. For the sake of simplicity the geometrical relationships relating to the elongated members are shown in FIG. 2 only. FIGS. 3–7 show the various possible sizes of the elongated members.

Figure 9:
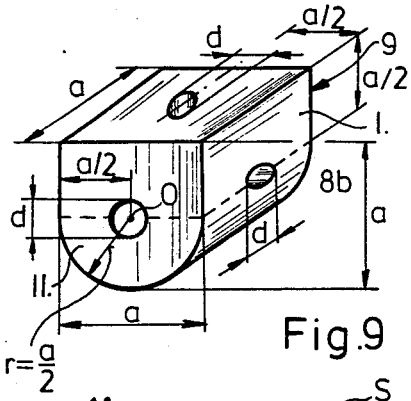
FIG. 9 is a perspective view of a connecting member comprising a semi-cylinder and a rectangular prism.

FIG. 9 shows a connecting member 9 which can be used as an intermediate coupling member between the individual elements in the set, and by means of the application of the connecting member 9 the number of configurations which can be made by the construction set can be increased significantly. When the connecting member 9 is used, the assembled figures will have a different character of appearance. The connecting member 9 comprises a rectangular prism I and a half cylinder II which parts are united to form a single integrated body. It can be seen in FIG. 9 that the width and the height of the connecting member 9 are both equal to the basic size a as well as its length which also conforms to this size. With these dimensions the connecting member 9 fits harmonically in the other members of the set, shown in FIGS. 1–8. The connecting member 9 comprises three threaded, orthogonal holes 8*b*, which have mutually perpendicular axes which cross each other in the centre of the connecting member 9. These axes can be considered as a spatial coordinate-system. The mouthes of the holes 8*b* lie in three different surfaces of the connecting member 9. With the geometrical relationships shown in FIG. 9 it can be seen that the distance between the centre points O of the holes 8*b* and the nearest planar surface of the member is equal of the half of the basic size a. The threaded holes 8*b* have a diameter d which conforms to the diameter of threaded bolts shown in FIGS. 21–27, whereby these bolts can be screwed in the holes 8*b*.

Figure 10:
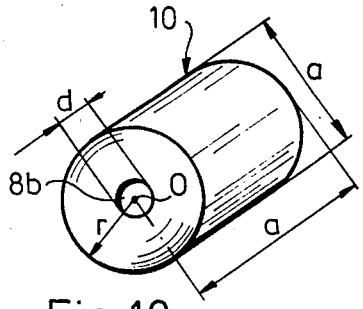
FIG. 10 shows a coupling member made of a cylinder.

FIG. 10 shows a cylinder 10 which can be used either as a coupling member or as a distance keeper. The diameter of the cylinder 10 is equal to the basic size a and its length is also just as large. There is provided a central bore or two central bores in the cylinder 10 which can be threaded bores 8*b* with a diameter d or throughgoing holes with a diameter D. When threaded bores are made in the cylinder 10, the threaded bolts can be screwed therein.

Figure 11:
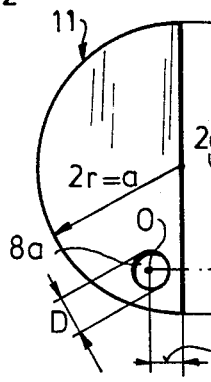
FIGS. 11 and 12 show additional building members made of half discs.
Figure 12:
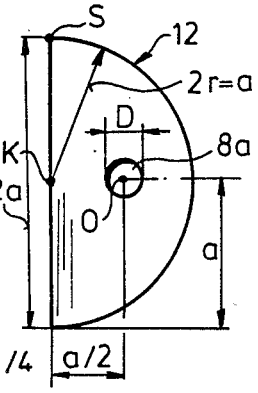

FIGS. 11 and 12 show two semi-circular members 11 and 12 which have a thickness equal to the basic thickness v. The diameter of the semi-circular members 11 and 12 is twice as great as the basic size a, that is, their radius is just equal to the basic size. Near to a corner of the member 11 there is provided a throughgoing hole 8*a* which has a centre point O which lies in both directions at a distance of a/4 from the corner point S. In the semi-circular member 12 shown in FIG. 12 the difference lies in, that the centre point of the throughgoing hole lies on the symmetry-axis of the member and the distance between the centre point and the linear section of the member 12 is equal to a/2. The diameter of these holes is equal to the basic diameter D.

Figure 13:
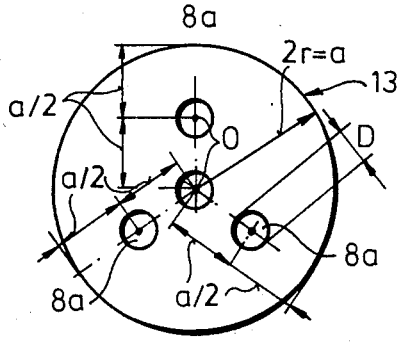
FIGS. 13 and 14 show two embodiments of further disc members.
Figure 14:
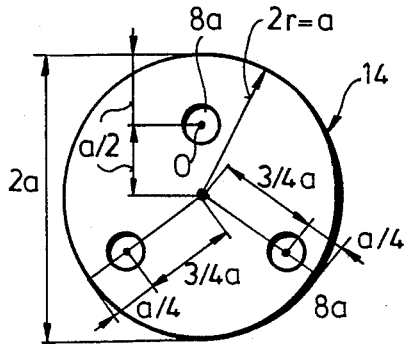
Figure 15:
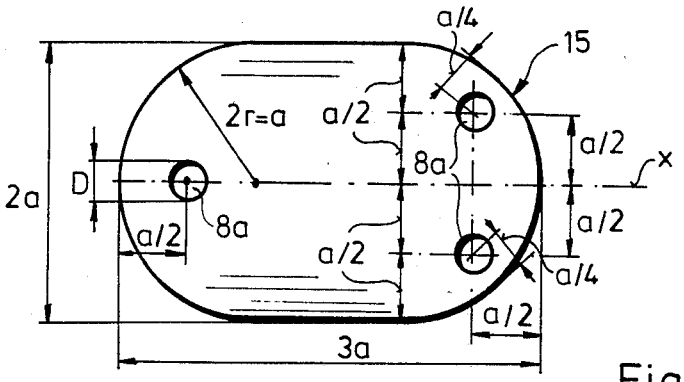
FIGS. 15 and 16 show further elongated members with different hole arrangement.
Figure 16:
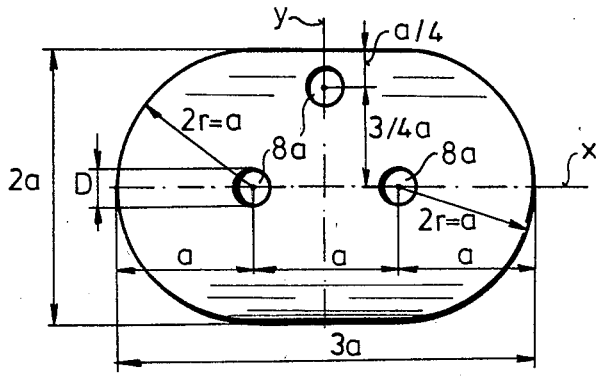
Figure 17:
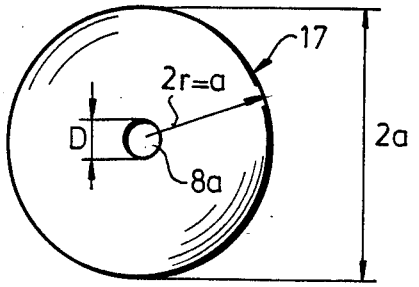
FIG. 17 shows a further disc member with a double diameter compared to that shown in FIG. 1.

FIGS. 13 and 14 show disc members 13 and 14 with a thickness equal to the basic thickness. The diameter of the discs is twice as large as the basic size a. The disc member 13 comprises four throughgoing holes 8*a* with a diameter D, one of them is arranged centrally while the remaining three holes are arranged in the apex points of a regular triangle. The radial distance between these apex points and the centre of the disc is equal to the half of the basic size a. The disc member 14 shown in FIG. 14 comprises three throughgoing holes 8*a* arranged in the apex points of a isosceles triangle show that two of these points are at a distance of $\frac{3}{4}$a from the centre point or axis O of the disc 14, while the distance between the remaining hole and the centre point is a/2. FIGS. 15 and 16 show elongated members 15 and 16 which have a length of 3*a* and width 2*a*, and the radius of their end circles is equal to a. In the longitudinal axis x of the member 15 there is provided a hole 8*a* with a centre lying at a distance of a/2 from the end point of the member. In the elongated member 15 there are provided further two throughgoing holes of diameter D arranged symmetrically relative to the axis x at a distance of a/2. The longitudinal distance between these holes and the corresponding end point of the member 15 is also a/2. The elongated member 16 comprises also three throughgoing holes with a diameter D, two of them are arranged on the longitudinal axis x, symmetrically to the transversal axis y, and the third hole is arranged on the axis y. The distance between the axis y and the first two holes is equal to the basic size a, while the distance between the axis x and the third hole is equal to $\frac{3}{4}$a. It can be observed that the three centre points of the holes in the members 15 and 16 fall on the apex points of respective isosceles triangles. The thickness of the members 15 and 16 is equal to the basic thickness v.

FIGS. 17–20 show further members 17–20 which can complement the members shown in FIGS. 1–16 to make the construction set more versatile. Disc 17 has a diameter twice the basic size a and this double size is equal to the width of the elongated element 18–19 and 20. However, the length of the elongated elements remains an integer multiple of the basic size a. The disc 17 comprises a central hole of diameter D, and the diameter of the semi-circles at the end regions of members 18–20 is double the basic size. The elongated members 18–20 comprise respective pairs of throughgoing holes arranged on their longitudinal axis x and the central point of these holes are at a distance of a from the nearest end points of the member. It can be seen that for the elongated members 18–20 the previously described rules are valid according to which the distance between the end points and the centres of the throughgoing holes is half the width of the members. Of the members 18–20 the basic geometrical relationships have been illustrated only in connection with member 18. The thickness of these members is equal to the basic thickness.

Figure 28:
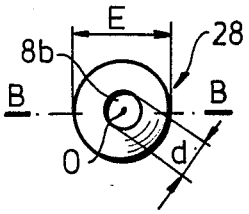
FIG. 28 shows a circular nut used for engagement with the threaded bolts.
Figure 29:
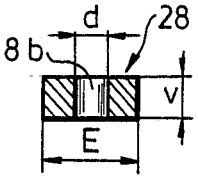
FIG. 29 is a sectional view taken along lines B—B of FIG. 28.

FIGS. 21–29 show the embodiment of the coupling members used in the construction set. There are threaded bolts 21–27 shown in FIGS. 21–27 which have an outer diameter d and length $1_1 \ldots 1_n$ which are an integer multiple of the basic width d. The diameter d is selected so that bolts should loosely fit the basic diameter D throughgoing holes 8*a*. The length of the shortest threaded bolt 21 designated by $1_1$ is four times as long as the basic thickness v. FIGS. 28 and 29 show disc-shaped nuts 28. The thickness of the nut 28 is equal to the basic thickness v, while the outer diameter E is smaller than the basic size a. In a preferable embodiment the basic size a can be 50 mm, the basic diameter D; 12 mm, the diameter of the threaded bolts d can be somewhat smaller such as 12 mm, while the outer diameter of the nuts 28 can be about 30 mm. The shortest should threaded bolts should $1_1$ at least of 4v, because the bolts should be used for coupling at least two members with a combined width of 2v, and the respective width of the two nuts at the two ends of the coupling is 2v.

The threaded bolts shown in FIGS. 21–27 have a spindle-like form. Instead of this form bolts with heads e.g. of a size of the nuts can be used, and in that case it is sufficient if the minimum length of the bolts is equal to 3v.

Figure 30:
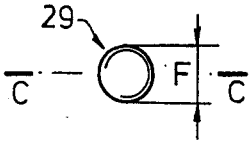
FIG. 30 shows a distance keeping member.
Figure 31:
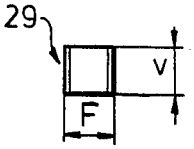
FIG. 31 is a sectional view taken along line C—C of FIG. 30.

FIGS. 30 and 31 show distance rings 29 made preferably of a resilient plastic material with a length substantially equal to the basic thickness v and an outer diameter F somewhat greater than the basic diameter D. In an alternative embodiment instead of the rings short threaded cylinders can be used as distance keeping members.

Figure 32:
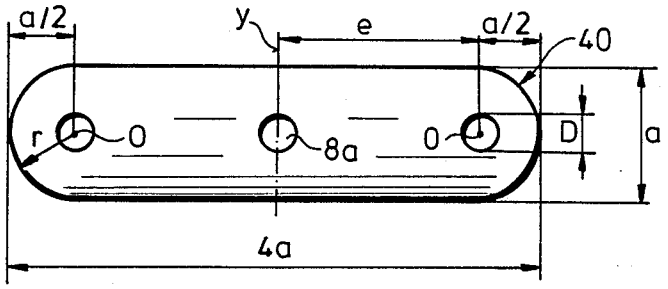
FIGS. 32–35 show a set of elongated members comprising different kinds of holes along their longitudinal axes.
Figure 33:
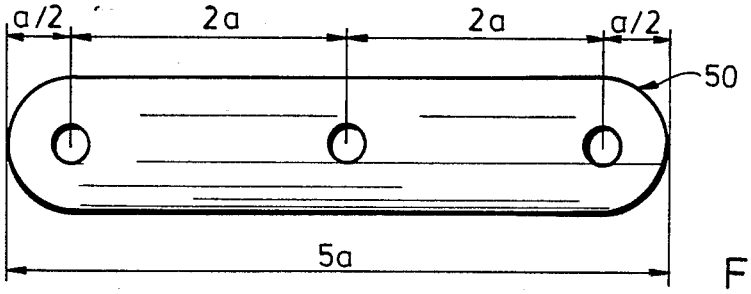
Figure 34:
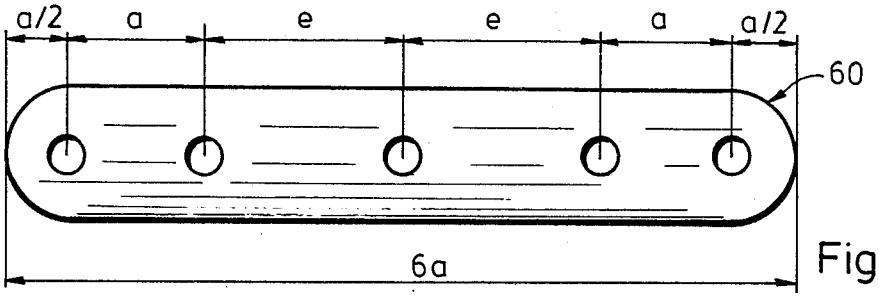
Figure 35:
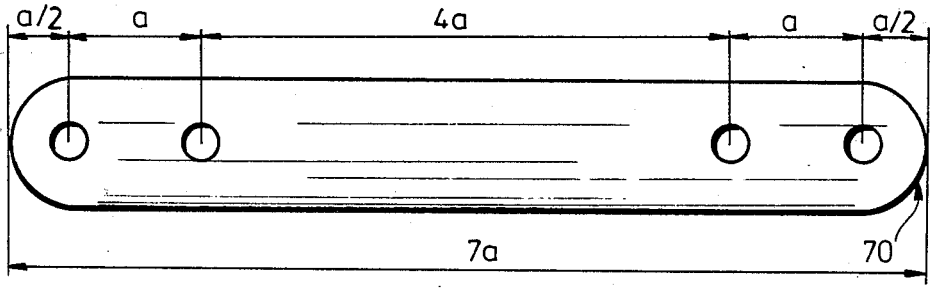
Figure 37:
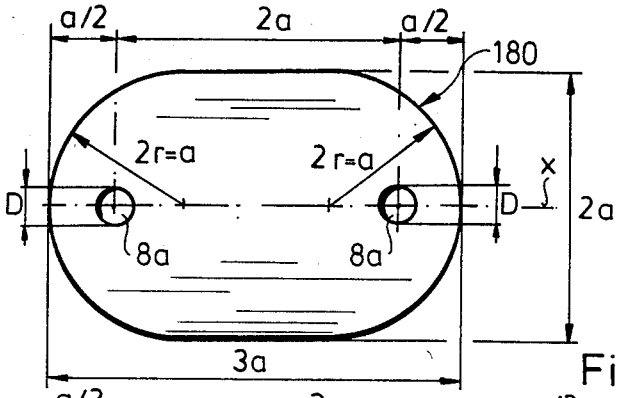
FIGS. 37–40 show further embodiments of elongated members with double size.

FIGS. 32–35 show elongated members 40, 50, 60 and 70 which are similar to the members 4–7 shown in FIGS. 4–7, the only difference lies in that, in addition to the holes 8*a* at the two end regions, they are provided with additional holes with diameters D, which additional holes are arranged on the longitudinal axis x of the members. The elongated member 40, which has a length 4*a* and a width a, comprises a third hole in the middle of its body i.e. where the transversal axis y crosses the longitudinal axis. The distance between the medium hole and the two holes at the end regions is designated by e in which $a<e<2a$. In FIGS. 33–35 only the full length of the members and the geometrical sizes defining the positions of the respective holes have been illustrated. The elongated member 50 with a length 5*a* also comprises three holes, two at the end regions and one in the middle. The distance between the middle hole and the other holes is equal to 2*a*. The elongated member 60 shown in FIG. 34 comprises five holes arranged in such a way that the two outermost holes are in a distance of a/2 from the two end points of the member, the two next holes are arranged at a distance a inner relative to the outermost holes, and the fifth hole in the middle is at a distance e from its neighbouring holes, in which $2a>e>a$. The elongated member 70 shown in FIG. 35 comprises two pairs of holes, the inner pair of holes are arranged at a distance a from the outer pair. As it can be seen in the drawings the position of each hole is defined by the position of its centre point O as illustrated in FIG. 32.

Figure 36:
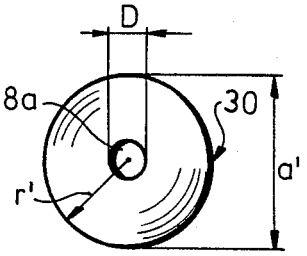
FIG. 36 shows a further disc member.
Figure 38:
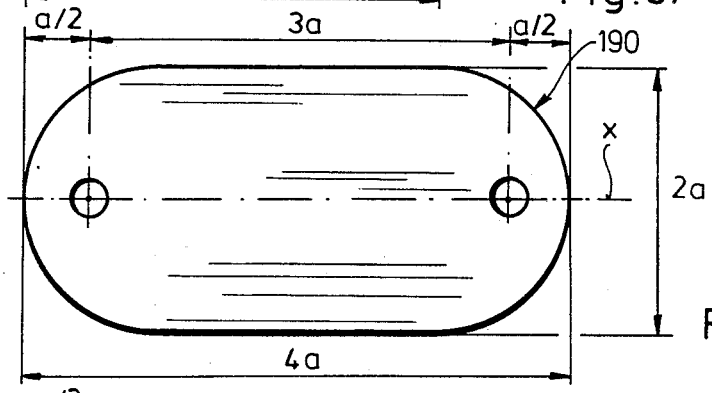
Figure 39:
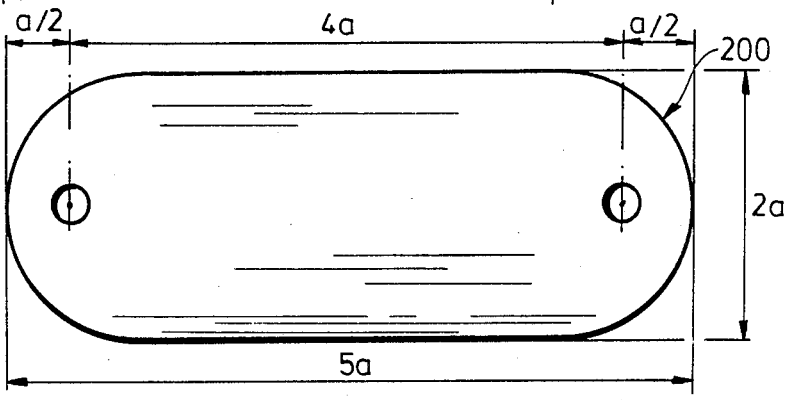
Figure 40:
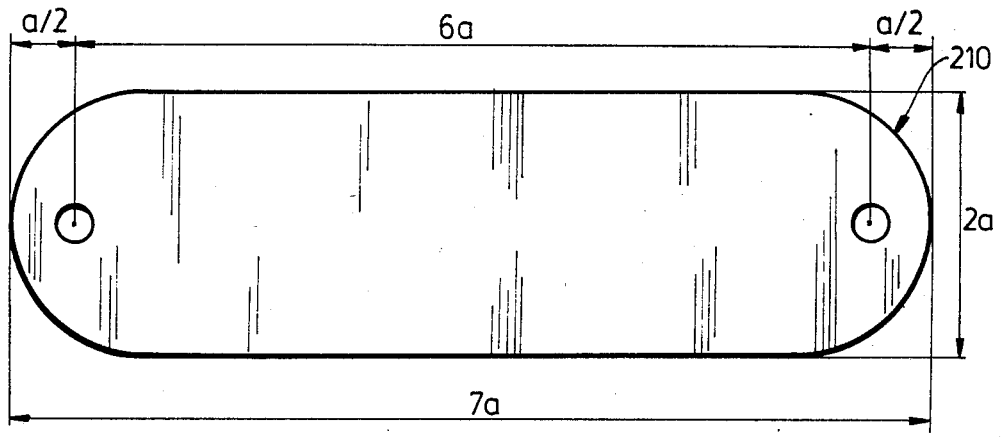

FIG. 36 shows a disc member 30 which is similar to the disc 1 shown in FIG. 1, the difference lies in that the disc member 30 has a diameter a′ greater than the basic size a, but it is smaller than the double of the basic size 2*a*, i.e. $2a>a'>a$.

Figure 18:
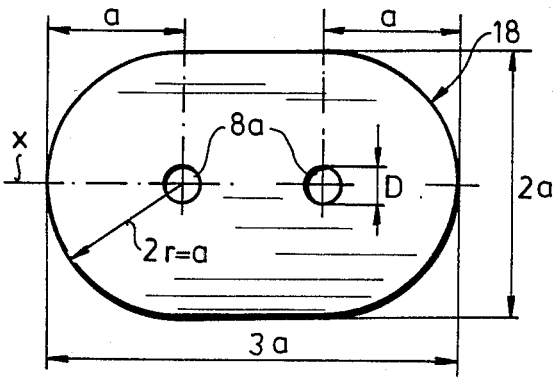
FIGS. 18–20 show additional elongated members having double size compared to those shown in FIGS. 2–4.
Figure 19:
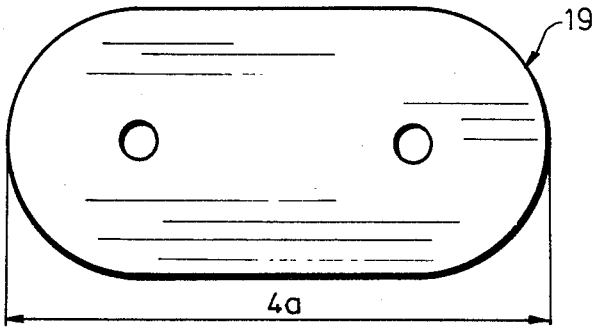
Figure 20:
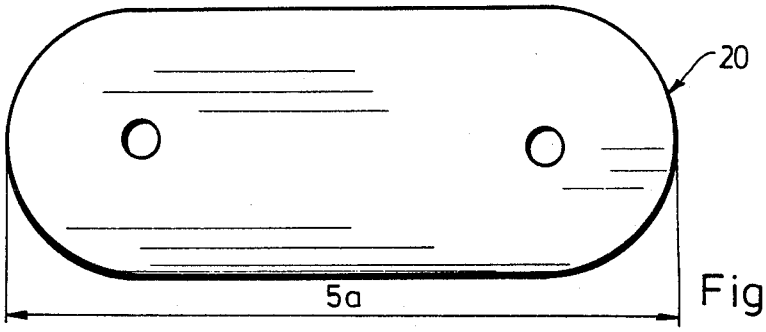
Figure 21:
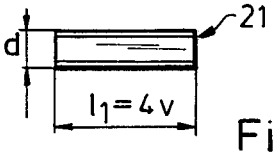
FIGS. 21–27 show various embodiments of threaded bores used as coupling members.
Figure 22:
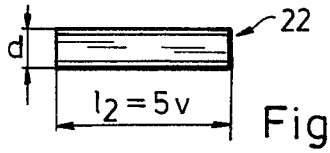
Figure 23:
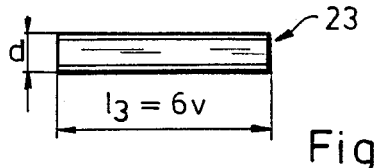
Figure 24:
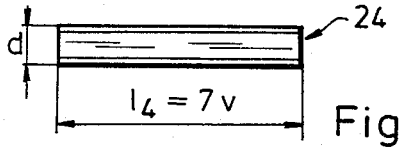
Figure 25:
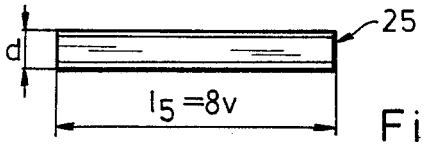
Figure 26:
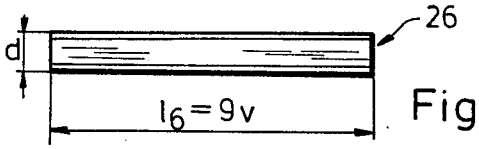
Figure 27:
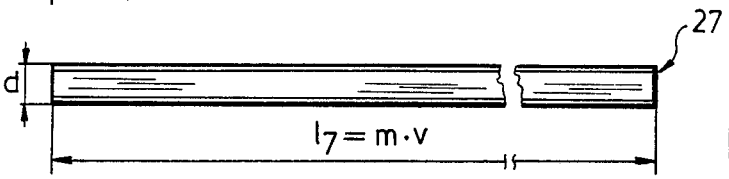

FIGS. 37–40 show elongated members 180, 190, 200, 210, respectively which are similar to the members shown in FIGS. 18–20, and their width is the double of the basic size a, their length is an integer multiple of the basic size. These elongated members also comprise respective holes at their end regions of a diameter equal to the basic diameter D. These holes have centre points falling on the longitudinal axis. The distance between the centre points of these holes and the nearest end points of the members is equal to the half of the basic distance a. The thickness of these members is equal to the basic thickness v.

It should be noted, that the length of the elongated elements is not limited to the numerical examples illustrated in the drawings and the elongated elements can be made as long as it is contempleted to be sufficient for a given set.

Figure 41:
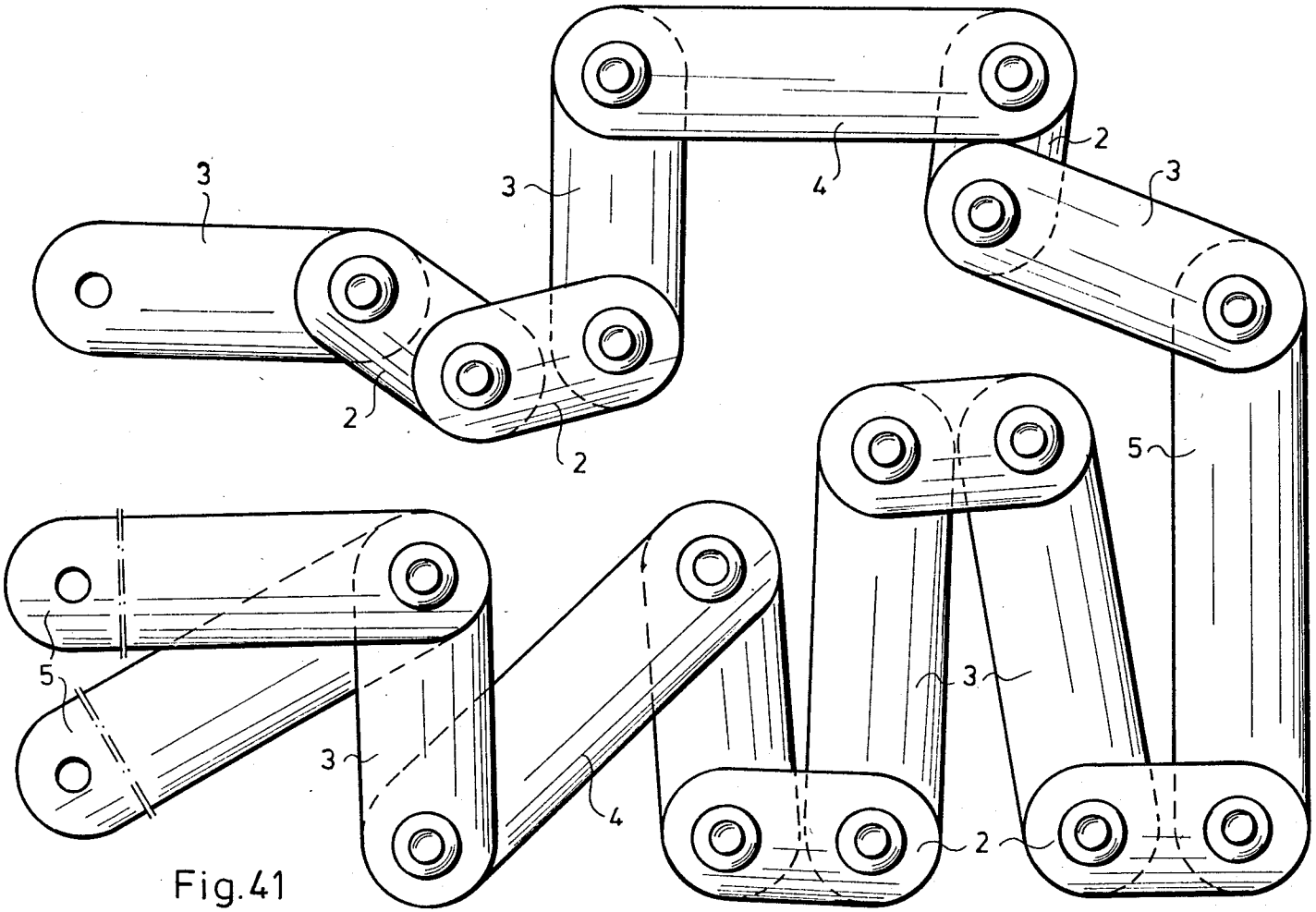
FIGS. 41–46 show various configurations which can be assembled by means of the members shown in FIGS. 1–40.

FIGS. 41–46 show a number of exemplary toy constructions which can be assembled by using the members shown in FIGS. 1–40. FIG. 41 shows a crocodile-like model made of elongated members 2–5 and of coupling members. For the sake of simplicity the coupling members have not been designated by reference numbers. It can well be understood that by loosing the coupling members and by turning or rotating the elongated members followed by the fastening of the coupling members the configuration of FIG. 41 can be converted into a pratically unlimited number of shapes, varying between a linear line section and a wheel-like, completely bent form.

Figure 42:
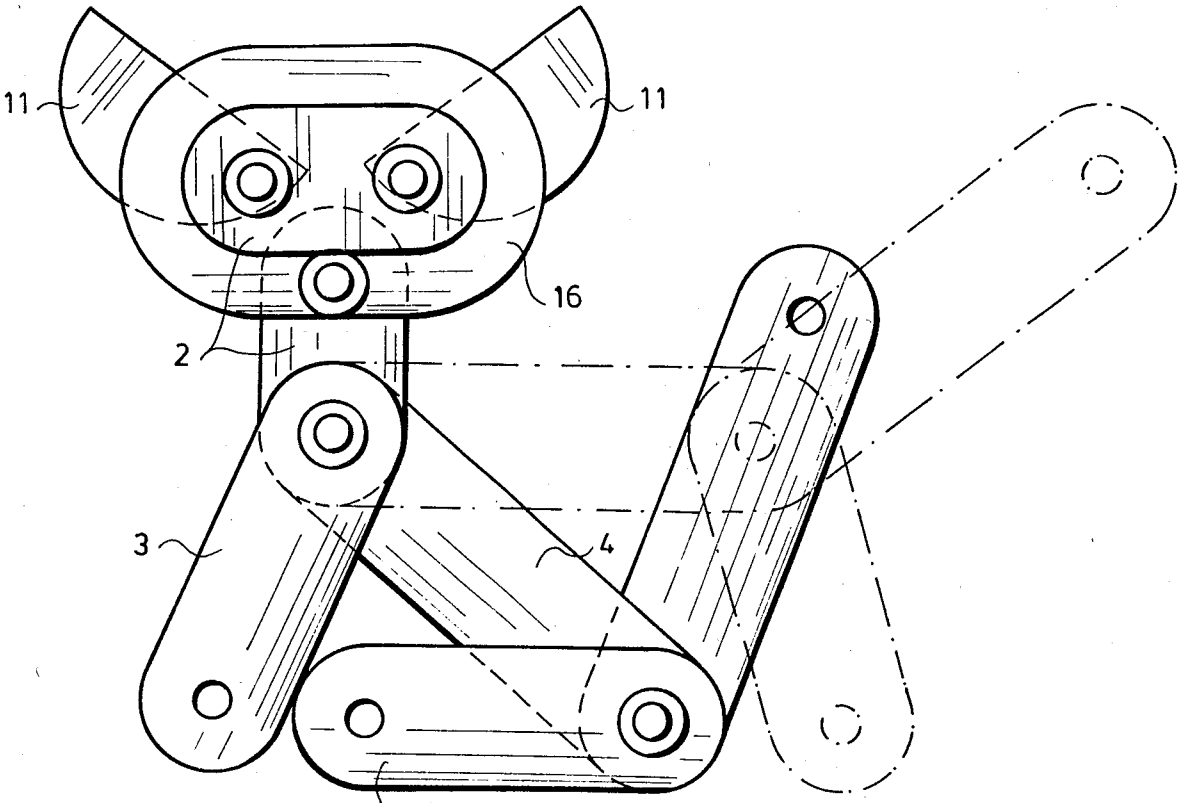

FIG. 42 shows a cat-figure which is sitting in the position shown in full lines, and if three of its component members are turned in the position shown by the dash lines, the cat will be standing. In this embodiment in addition to the coupling members the members 2, 3, 4; 11 and 16 have been used to make the desired shape.

Figure 43:
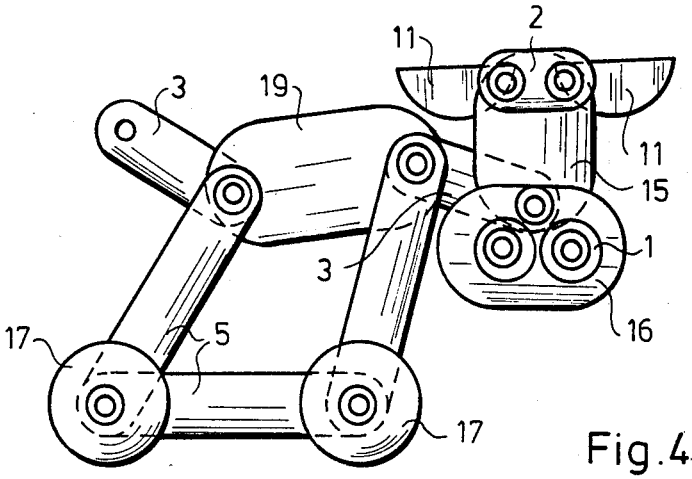
Figure 44:
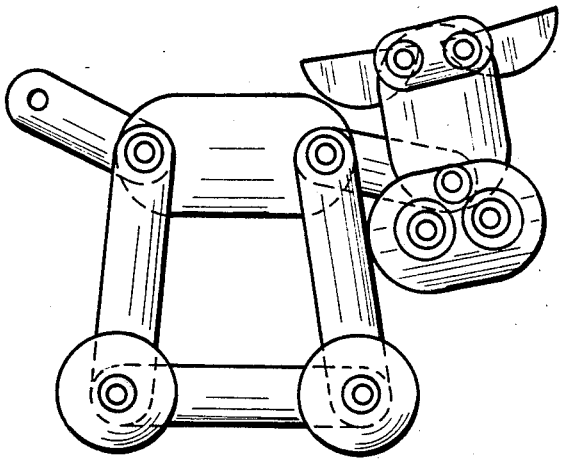
Figure 45:
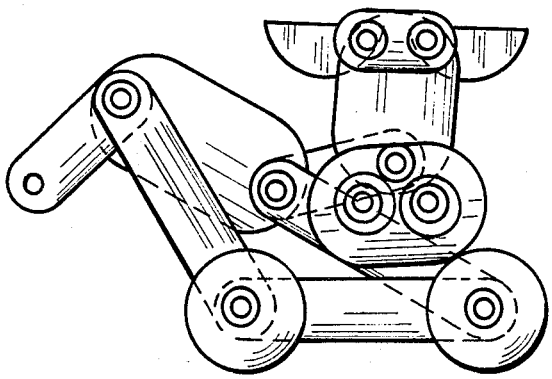

FIGS. 43–45 show a cow-figure in three different positions, whereby it will be clear how many positions can be realized by the construction set according to the invention even within the same general configuration. The cow-figure has been made by the members 1, 2, 3, 5; 11, 15, 16, 17 and 19 and by the appropriate number of coupling members.

Figure 46:
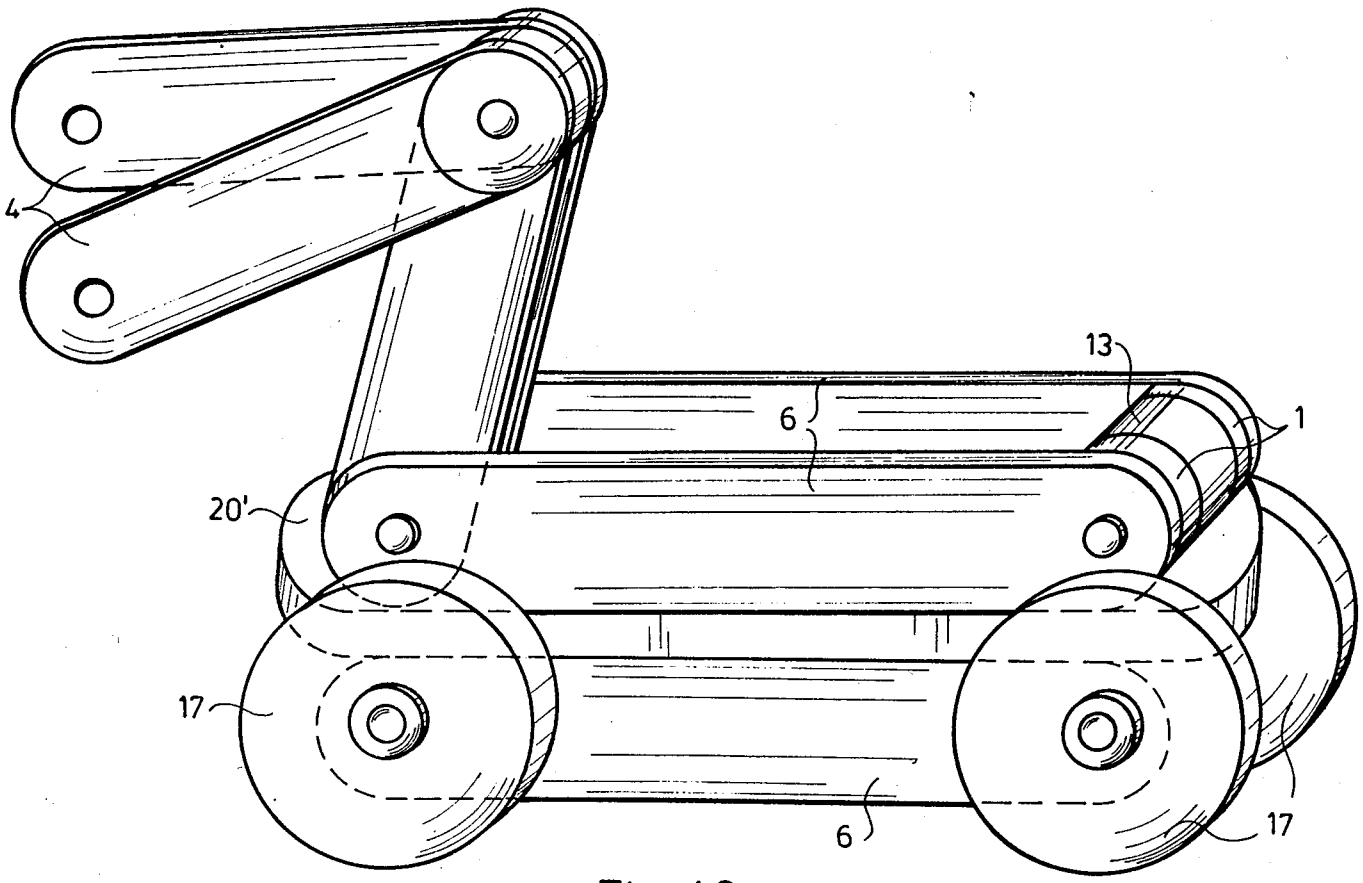

FIG. 46 shows a dog-like body in which connecting members 13 have also been used, and one of the connecting members 13 can be seen in the drawing. In addition to the coupling members the members 1, 4, 6, 17 have been used for this configuration and in addition to these elements a member 20′ has also been used which is similar to the elongated member shown in FIG. 20, but it has a length of 6*a*. The figure shown in FIG. 46 can be considered by a child not only as a dog, but as a small couch or a box-like figure and it can also be considered as a bird shiluette. The large number of possible explanations makes it clear that the construction set according to the invention offers a wide field for the phantasy of the child whereby his or her creational ability will be developed.

The advantages offered by the present invention can be summarized as follows:

The construction set combines the advantages of planar and spatial building sets without their drawbacks. It motivates children for creating always newer and newer forms, whereby their creativity is increased develops childrens' aesthetical sense, and offers a wide scope for the improvement of their fantasies. Although reliable joints are made by threaded bolts and nuts made preferably of wood, the automatic development of childrens' manipulating and assembling ability is assured by the present invention. Even with a comparatively few number of building members the construction set according to the present invention offers a wide scope for combinational possibilities, since a large number of models such as machines including cranes, cars, helicopters, airplanes as well as several kinds of animal models such as cows, horses, dogs, snakes, etc. can be assembled there width. The elements of the set are easy to manufacture and the set itself can be packed and circulated in appropriate compact units.

The invention can not be limited to the preferable embodiments explained and illustrated hereinabove and it can be modified and changed without departing from the essence and spirit thereof. It should be emphasized that wood is considered to be the most appropriate material for the various elements of the construction set, however, the application of other materials such as appropriate plastic materials can also be useful.

I claim:

1. A toy construction set, comprising building members and coupling members, said building members comprising:

disc members of a diameter forming a basic size a, said disc members having a common basic thickness v being at least one sixth and at most one third of said basic size a, said disc members including respective central throughgoing holes of a common basic diameter D being at least one sixth and at most one third of said basic size a;

elongated members with shapes symmetrical both to the longitudinal and transversal axes thereof, said elongated members having a common width substantially equal to said basic size a and a common thickness substantially equal to said basic thickness a, and having respective end regions with contour lines approaching semi-circles with diameters substantially equal to said basic size a, said elongated members having in said end regions respective throughgoing holes with diameters substantially equal to said basic diameter D, said holes have their center points lying on said longitudinal axis at a distance from the respective outermost points of said regions which is substantially equal to the half of said basic size a;

said coupling members comprising:

threaded bolts with an outer diameter d loosely fitting in said holes with said basic diameter D, said bolts having lengths at least about three times as long as said basic thickness v; and nuts for engagement with said bolts, said nuts being outer size smaller than said basic size a and being larger than half said basic size a, said nuts being of thicknesses at most equal to said basic thickness a;

said building members further comprising connecting members having a width and height substantially equal to said basic size a, and a length at least equal to said basic size a, said connecting members being symmetrical relative to at least one symmetry plane and comprising pairs of end planes normal to said symmetry plane and a planar face normal to said end planes, and said connecting members each comprising at least two threaded bores with diverging axes for receiving and engaging said bolts;

said connecting members being formed by a semi-cylinder with a diameter equal to said basic size a and by a rectangular prism attached integrally to said semi-cylinder;

said connecting members having three said threaded bores whose axes are mutually normal to each other and intersect each other in the middle of said connecting member;

said building members further comprising additional elongated members having a common thickness substantially equal to said basic thickness v, said additional elongated members having shapes similar to that of said elongated members but having a common width substantially twice said basic size a, said additional elongated members having in their end regions respective throughgoing holes being substantially as large as said throughgoing holes of said disc members and having center points lying on the longitudinal axes of said members at a distance from the outermost points of said regions which is substantially equal to the half of said basic size a;

said building members further comprising additional disc members having diameters twice as large as said basic size a and central holes with diameters substantially as large as said basic diameter D, said additional disc members having a thickness substantially equal to said basic thickness v;

said building members further comprising semi-circular members with a diameter about twice said basic size a and with a thickness being substantially equal to said basic thickness v, each of said semi-circular members having at least one hole therewithin of a diameter equal to said basic diameter D;

said building members further comprising further elongated members having a common thickness substantially equal to said basic thickness v, said further elongated members having shapes similar to that of said elongated members but having a common width being substantially twice of said basic size a, said further elongated members having in their end regions respective throughgoing holes with diameters substantially equal to said basic diameter D, said holes having their center points on the longitudinal axes of said members at a distance from the outermost points of said region which is substantially equal to said basic size a; and said basic size a being at least 25 mm.

2. The construction set as claimed in claim 1, wherein said contour lines in the end regions of said elongated members are formed by said semi-circles.

3. The construction set as claimed in claim 1, wherein said contour lines in the end regions of said elongated members being formed by linear sections osculating said semi-circles.

4. The construction set as claimed in claim 1, wherein said nuts are circular and have a width substantially equal to said basic thickness a.

5. The construction set as claimed in claim 1, wherein said basic diameter D is substantially equal to said basic thickness v and is substantially equal to the quarter of said basic size a.

6. The construction set as claimed in claim 1, wherein said elongated members have lengths which are multiples of said basic size a.

7. The construction set as claimed in claim 1, wherein said building members have further throughgoing holes with diameters substantially equal to said basic diameter D and arranged symmetrically relative to said axis.

8. The construction set as claimed in claim 1, where said coupling members comprise a cylinder with a diameter equal to said basic size a, said cylinder being at least as long as said basic size and having a central bore of a size substantially as large as said basic diameter D.

* * * * *